United States Patent [19]

Shuler

[11] 4,061,082

[45] Dec. 6, 1977

[54] VENTILATING AIR FILTERING AND DISTRIBUTING DEVICE

[75] Inventor: Bernard R. Shuler, Louisville, Ky.

[73] Assignee: American Air Filter Company, Inc., Louisville, Ky.

[21] Appl. No.: 623,608

[22] Filed: Oct. 20, 1975

[51] Int. Cl.[2] ..... F24F 13/06; B01D 31/00

[52] U.S. Cl. ..... 98/40 D; 98/40 B; 55/418

[58] Field of Search ..... 98/40 DL, 40 D, 40 B, 98/33 R; 55/418; 138/44, 45, 46; 239/553.3, 553.5; 251/121, 210

[56] References Cited

U.S. PATENT DOCUMENTS

| | | | |
|---|---|---|---|
| 2,251,663 | 8/1941 | Darbo | 55/418 |
| 2,662,463 | 12/1953 | Kurek | 98/40 D |
| 2,845,855 | 8/1958 | Burns | 98/40 DL |
| 3,001,464 | 9/1961 | Moore | 55/418 |
| 3,240,145 | 3/1966 | Lambert | 98/40 D |
| 3,388,868 | 6/1968 | Watson et al. | 239/553.3 |
| 3,465,666 | 9/1969 | Knab | 98/40 D |
| 3,522,724 | 8/1970 | Knab | 98/40 D |
| 3,724,502 | 4/1973 | Hayner et al. | 138/44 |
| 3,752,439 | 8/1973 | Thomas | 55/418 |
| 3,780,503 | 12/1973 | Smith | 55/418 |
| 3,812,770 | 5/1974 | Morozov | 98/40 D |
| 3,818,815 | 6/1974 | Day | 98/40 D |

FOREIGN PATENT DOCUMENTS

| | | | |
|---|---|---|---|
| 864,894 | 10/1957 | United Kingdom | 98/40 DL |

*Primary Examiner*—John J. Camby
*Assistant Examiner*—Henry C. Yuen
*Attorney, Agent, or Firm*—Jon C. Winger

[57] ABSTRACT

A ventilating air filtering and distribution device particularly well suited for installation in the ceiling or walls of an environmentally controlled room which room requires a laminar ventilating air flow. The device includes a plenum structure defining a dirty air plenum chamber, and has a dirty air inlet in one face and a clean air outlet in an opposite face. A pair of damper-diffuser plates are adjustably attached to a support beam disposed proximate the clean air outlet, thus, leaving the dirty air inlet unobstructed with support structure. Additionally, filter media is disposed across the clean air outlet to filter the ventilating air as it exits the plenum structure through the clean air outlet.

15 Claims, 19 Drawing Figures

VENTILATING AIR FILTERING AND DISTRIBUTING DEVICE

BACKGROUND OF THE INVENTION

The present invention pertains to gas filtration and more particularly to a device for filtering ventilation air which has inlet air damping and distribution means.

Various types of ventilating air filtering and distribution devices having inlet air distribution means are known. However, the heretofore known devices have the air distribution means attached at the air inlet to the device. The attachment structure, thus, interferes with the flow of incoming air creating an undesireable pressure drop and an air flow turbulence at the inlet.

Further, the prior art devices have done little to eliminate non-uniform, or sharp, outlet air velocity profiles as measured across the outlet from the device. A uniform outlet air velocity profile is important in order to maintain a laminar air flow in an area served by the ventilating device.

Further, some prior art ventilating air filtering and distribution devices use a two piece butterfly-type damper located in the air inlet. This butterfly-type damper requires a relatively complicated and, therefore, expensive worm gear to actuate the two pieces of the valve.

In some applications, the butterfly damper is oriented to open by having the two pieces thereof pivot inwardly or into the inlet. It has been known to occur, when subjected to high incoming air velocities, that the butterfly damper is blown to a closed position, thus, potentially causing damage to the ventilating system due to the sudden creation of high pressure blockages in the system.

In other applications, the butterfly damper mentioned above has been reoriented to open by having the two pieces thereof pivot outwardly of the inlet, thus, solving the problem of the damper being blown to a closed position when subjected to high incoming air velocities. However, when oriented to openby having the two pieces pivot outwardly of the inlet, the damper can be blown to an open position when subjected to a high inlet air velocity. While this orientation limits potential damage to the ventilating system caused by high pressure blockages when the damper is blown closed, it will result in destroying a balanced laminar air flow into the room being ventilated.

Another prior art ventilating air distribution device is disclosed in U.S. Pat. No. 3,818,815, issued on June 25, 1974 to Thomas L. Day. This patent discloses a hood-like stucture having an inlet duct and an air discharge outlet. Two identical perforated plates are sandwiched together and mounted to one end of an adjustment shaft. The adjustment shaft is coaxially disposed relative to the inlet duct and is threadably mounted at its other end to a plate disposed in and attached to the inlet duct. The perforated plates are larger than the inlet duct and are mounted to the shaft for selective transverse movement relative to the axis of the shaft. A drawback of this device is that the shaft mounting plate being disposed in and attached to the inlet duct interferes with the incoming air flow creating a turbulence and an undesireable pressure drop. Additionally, this device does little to create a uniform outlet air velocity profile across the outlet. Indeed, depending upon the lateral locations of the perforated plates relative to the inlet duct a non-uniform outlet air velocity profile would be encouraged.

SUMMARY OF THE PRESENT INVENTION

The present invention recognizes the above-mentioned drawbacks of the prior art and provides a solution which not only obviates these drawbacks, but additionally has as its further objects, a device which converts the velocity pressure generated within the device by the incoming dirty air to static pressure, thus, eliminating sharp ventilating air velocity profiles at the outlet from the device, and a device with a low dimensional profile for installation in small spaces.

More particularly, the present invention provides a ventilating air filtering and distribution device comprising: a plenum structure defining a plenum chamber having an air inlet in one face and an air outlet in the opposite face; filter media disposed across the outlet from the plenum structure; damperdiffuser support means attached to the plenum structure proximate the outlet; and, damper-diffuser means adjustably mounted to the support means for movement toward and away from the inlet to selectively dampen and diffuse ventilating air to be filtered as it enters the plenum structure through the inlet.

DESCRIPTION OF THE DRAWINGS

A better understanding of the present invention will be had upon reference to the accompanying drawings wherein like numerals refer to like parts throughout the several views, and in which.

DESCRIPTION OF THE PREFERRED EMBODIMENT

Figure 1:
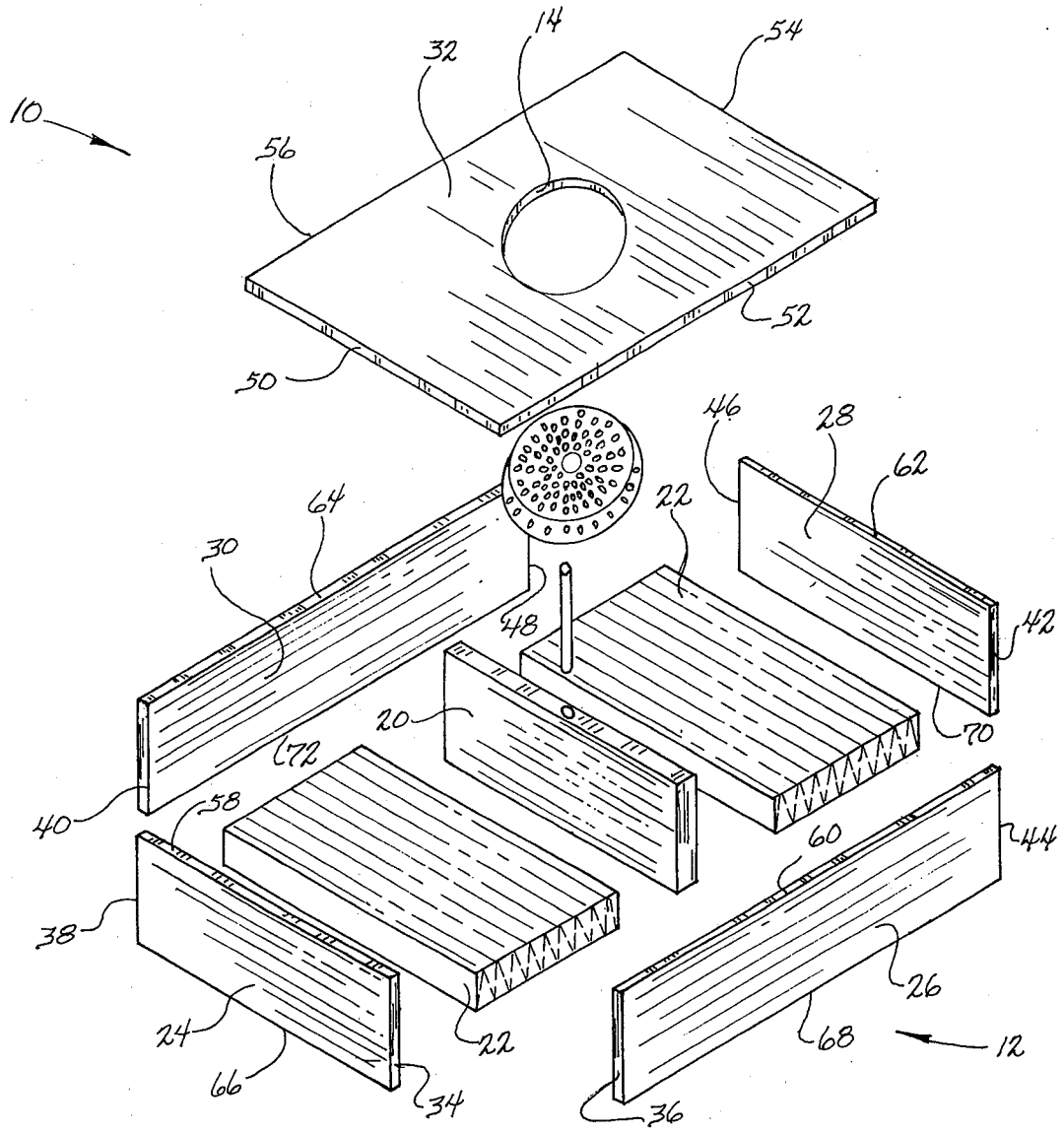
FIG. 1 is an exploded perspective view of a ventilating air filtering and distributing device of the present invention.

With reference to FIGS. 1, 2, 3, 4, 5 and 6, there is shown a ventilating air filter and distributing device, generally denoted as the numeral 10, which is particularly well suited for installation in the ceiling or walls of an environmentally controlled room, such as clean room or medical operating room. The device 10 comprises a plenum structure, generally denoted as the numeral 12, illustrated as being in the form os a parallelpiped, having an inlet 14 and an outlet 16; damper-diffuser means, generally denoted as the numeral 18, adjustably mounted to support means 20 attached to the plenum structure 12 proximate the outlet 16; and, filter media 22 disposed across the outlet 16.

The plenum structure 12 comprises four generally rectangular side walls 24, 26, 28 and 30; a flat generally rectangular top face or wall 32; the inlet 14, which is formed in the top wall 32; and, the outlet 16 opposite the top wall 32. The side wall 24 is disposed at right angles to the walls 26 and 30, and is attached at one end 34 to one end 36 of the wall 26 and at its opposite end 38 to one end 40 of the wall 30. The wall 28 is likewise disposed at right angles to the walls 26 and 30, and is attached at one end 42 to the other end 44 of the wall 26, and at its opposite end 46 to the other end 48 of the wall 30. Thus, the walls 24 and 28 are mutually parallel, and the walls 26 and 30 are mutually parallel. The flat top 32 is disposed perpendicular to the walls 24, 26, 28 and 30, and is attached along its sides 50, 52, 54 and 56 to the top edges 58, 60, 62 and 64 of the side walls 24, 26, 28 and 30, respectively, while the bottom edges 66, 68, 70 and 72 of the side walls 24, 26, 28 and 30, respectively, define the outlet 16. The filter media 22, illustrated as two separate HEPA filter cells, is disposed across the outlet 16 and is attached to the side walls 24, 26, 28 and 30, thus, closing the outlet 16. The upstream surface of the filter media 22, side walls 24, 26, 28 and 30, and top wall 32 cooperate to define a dirty air plenum chamber 74.

The side walls 24, 26, 28 and 30, and the top wall 32, can be fabricated from virtually any material, such as, for example, fiberglas, sheet metal or wood. Depending upon the material of the walls, they may be attached together by any convenient appropriate means, such as glue in the case of fiberglas, welds or screws in the case of sheet metal, or glue, nails or screws in the case of wood. In practice, it has been found that a wood construction is practical because it is relatively inexpensive and easy to work with and does not require the use of expensive metal bending machines or fiberglas molds.

Additionally, and as illustrated in the Figures, it has been found in practice that the side walls 24, 26, 28 and 30 can advantageously also comprise the frame of the filter media 22. When the filter media is being fabricated, the frame surrounding the filter media can be made to extend a predetermined distance past the upstream face of the media. Of course, an alternate construction would be to use a filter media having a filter frame and fabricate the plenum structure 12 with an outlet 16 sized to receive the filter and frame.

With reference to FIGS. 3, 4, 5 and 6, the damper-diffuser means 18 comprises two parallel spaced apart coaxially disposed perforated plates 76 and 78 which are coaxially disposed relative to the plenum structure inlet 14. The plates 76 and 78 are attached to one end 80 of movable adjustment rod 82 which is also coaxially disposed relative to the plenum structure inlet 14. Preferably, both the top plate 76, which is the plate closest to the inlet 14, and the bottom plate 78 are of a complementary shape to the inlet 14. That is, each plate 76, 78 presents a shape to the inlet 14 generally conforming to the shape of the inlet 14. Additionally, the top plate 76 is sized to be received in the inlet 14 while the bottom plate is larger than the inlet 14.

With reference to FIG. 3, 4, 5 and 6, the other end 84 of the adjustment rod 82 is movably mounted to the support means 22 which is illustrated as a beam disposed across the plenum chamber outlet 16. As can be best seen in FIG. 6, the beam 22 is attached at one of its ends 86 to the side wall 26 and at its other end 88 to the opposite side wall 30. The means for attachment will vary depending upon the material from which the plenum structure 12 and beam 22 are fabricated. In practice, it has been determined that wood is a convenient material from which to make both the plenum structure 12 and beam 22, and, therefore, screws, nails or glue are appropriate attachment means.

Figure 7:
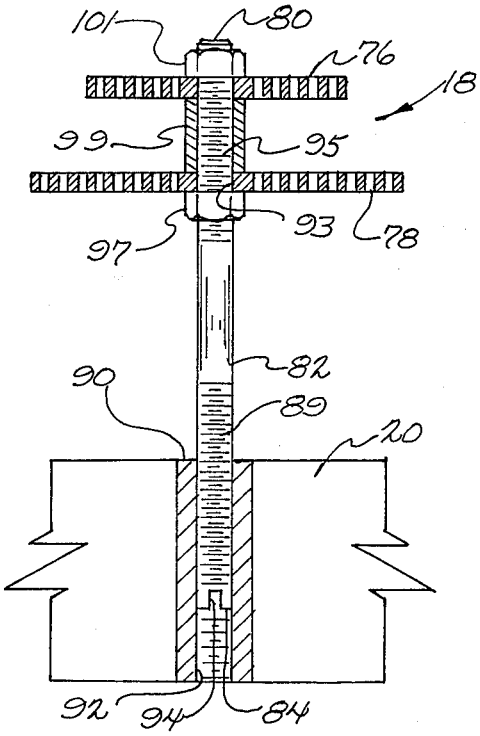
FIG. 7 is an enlarged view of the damper-diffuser assembly and adjusting means therefor.

An exemplary means for attaching the perforated plates 76 and 78 to the rod 82 is best illustrated in FIG. 7. The top perforated plate 76 is formed with a coaxially disposed aperture 91 and the bottom plate 78 is formed with a coaxially disposed aperture 93. A portion of the shank of the rod 82 proximate the rod end 80 is threaded as indicated by the numeral 95. A bottom keeper nut 97 is threaded onto the threaded rod portion 91 a predetermined distance from the rod end 80 corresponding to the position of the bottom plate 78 on the rod 82. The bottom plate 78 is disposed in abutting juxtaposition to the bottom keeper nut 97 by inserting the rod end 80 through the aperture 93. A spacer sleeve 99 of a predetermined length corresponding to the space to be maintained between the top and bottom plates 76, 78 is placed over the rod 82 so that one end of the spacer sleeve is in abutting juxtaposition to the opposite surface of the bottom perforated plate 78 from the surface thereof which is in abutment with the bottom keeper nut 97. The top perforated plate 96 is disposed in abutting juxtaposition to the other end of the spacer sleeve 99 by inserting the rod 82 through the aperture 91. A top keeper nut 101 is threaded onto the threaded rod portion 91 and tightened down against the opposite surface of the top perforated plate 76 from the surface which is in abutment with the end of the sleeve 99. Thus, the spacer sleeve 99 maintains the spacing between the top plate 76 and bottom plate 78 and the keeper nuts 97 and 101 captively secure the plates 76 and 78 in place on the rod 82.

One method of adjustably mounting the plates 76 and 78 to the beam 22 is illustrated in FIG. 7. The shank of the rod 82 proximate the end 84 thereof is threaded as indicated by the numeral 89. A collar 90 having a threaded bore 92 is disposed in the beam 22 coaxial with the plenum structure inlet 14. The threaded shank portion 89 of the rod 82 is threadably received in the threaded bore 92 of the collar 90. As the rod 82 is turned about its axis in one direction, for example, clockwise, the coaction between the threaded shank portion 89 and threaded bore 92 causes the rod 82 to move longitudinally toward the inlet 14. As the rod 82 is turned about its axis in the other direction, i.e., counter-clockwise, the coaction between the threaded shank portion 89 and the threaded bore 92 causes the rod 82 to move longitudinally away from the inlet 14. Of course, since the plates 76 and 78 are attached to the end 80 of the rod 82, they move with the rod 82 toward and away from the inlet 14.

To provide a means for moving the rod 82 from the exterior of the plenum structure 12, the rod end 84 is formed with a lateral slot 94 adapted to receive an end of a tool, such as a screwdriver. The shank of the tool can advantageously be provided with spaced apart transverse graduations which will conveniently indicate the position of the plates 76 and 78 relative to the inlet 14. As previously described, as the rod 82 is turned clockwise, it moves out of bore 92 toward the inlet 14, thus, the tool is turned clockwise, it moves out of bore 92 toward the inlet 14, thus, the tool used to turn the rod 82 will move axially into the bore 92. The graduations along the shank of the tool can be compared to the bottom edge 96 of the support beam 22 to give an indication of the position of the damper-diffuser plates 76 and 78 relative to the inlet 14. Similarly, as the rod 82 is turned counter-clockwise, it moves into the bore 92 and away from the inlet 14 and the tool will move axially out of the bore 92. Again, the graduations along the shank of the tool can be compared to the bottom edge 96 of the beam 22 to give an indication of the rotative position of the plates 76 and 78.

Figure 2:
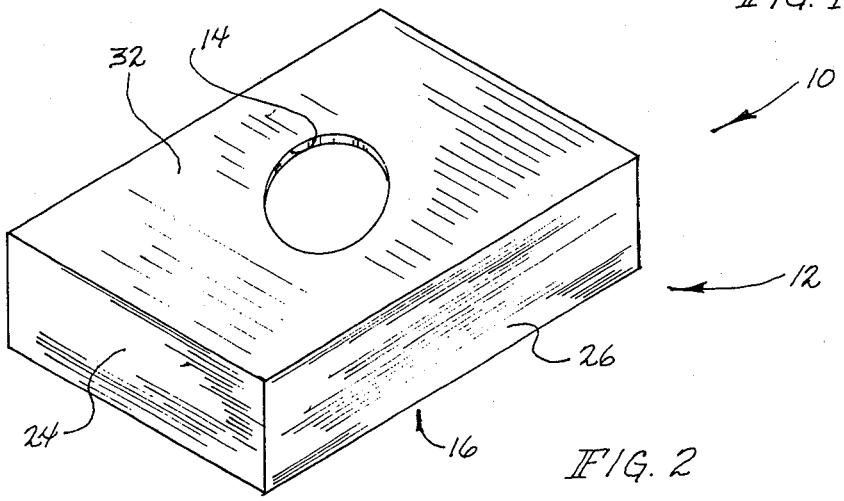
FIG. 2 is an assembled perspective view of the ventilating air filtering and distributing device of FIG. 1.
Figure 17:
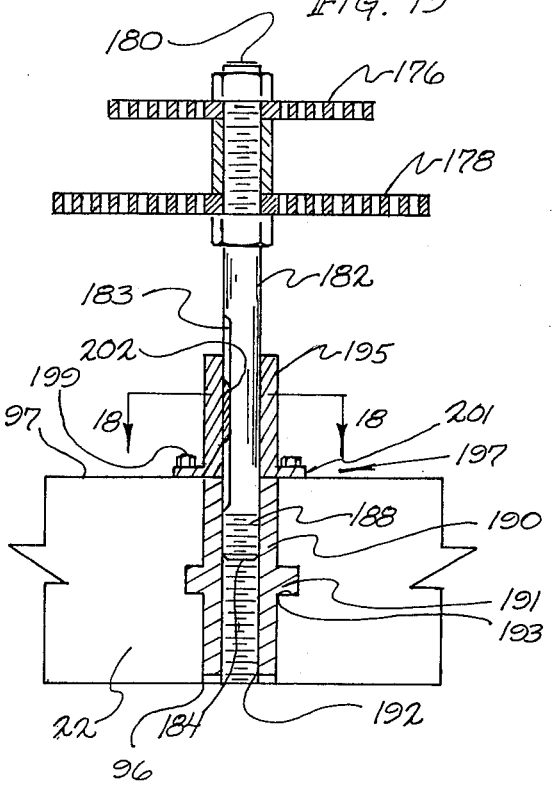
FIG. 17 is an enlarged view of another damper-diffuser assembly adjusting means.
Figure 18:
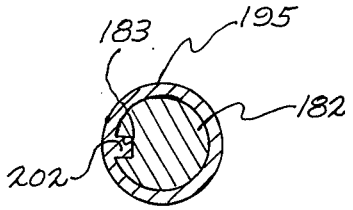
FIG. 18 is a cross-sectional view taken in a plane through line 18—18 of FIG. 17; and, FIG. 19 is a cross-sectional view of a ventilating air filtering and distribution device illustrating another embodiment of a damper-diffuser assembly.
Figure 15:
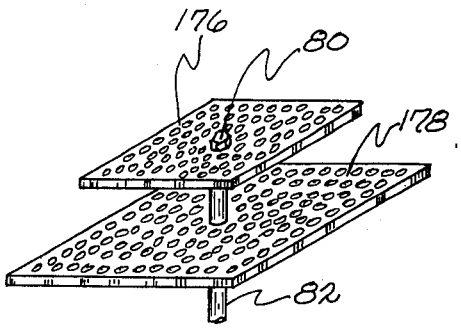
FIG. 15 is a perspective view of another embodiment of a damper-diffuser assembly.
Figure 16:
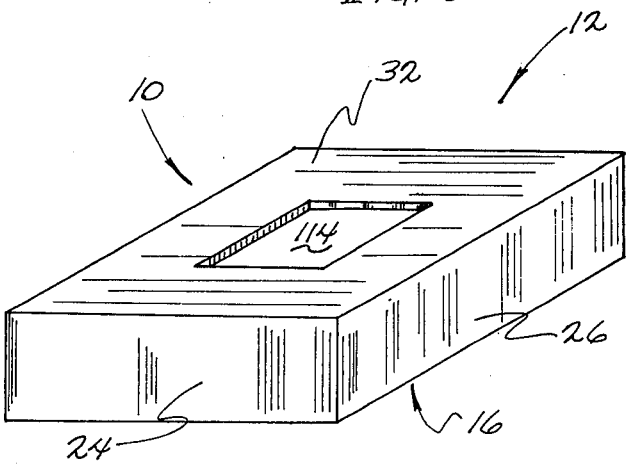
FIG. 16 is a perspective view of a filter hood of the present invention illustrating a rectangular inlet.

One advantage of the present invention is that the plenum structure inlet 14 can be virtually any shape. For example, FIGS. 1 and 2 illustrate a circular inlet 14 and FIG. 16 illustrates a square inlet 114. However, inlets of other geometric shapes can also be used. The shape of the plenum structure inlet will dictate that peripheral shape of the damper-diffuser plates, particularly the top most damper-diffuser plate because the top damper-diffuser plate is receivable in the inlet. FIG. 15 illustrates a perforated square flat top damper-diffuser plate 176 and a larger perforated square flat bottom damper-diffuser plate 178 used with a square inlet 114. When the plenum structure inlet is other than circular, the damper-diffuser plates must be prevented from rotating with the adjustment rod as the rod is turned about its axis to adjust the position of the damper-diffuser plates in order to prevent at least the top damper-diffuser plate from turning out of registration with the inlet. FIGS. 17 and 18 illustrate an exemplary means for accomplishing this task. As shown, the flat rectangular spaced apart damper-diffuser plates 176 and 178 are attached to the one end 180 of an adjustment rod 182. The rod 182 is formed with an open elongated longitudinally disposed channel 183 extending along at least a portion of the length of the rod 182. The shank of the rod 182 proximate its other end 184 is threaded as indicated by the numeral 188. A collar 190 having a threaded bore 192 is disposed in the support beam 22 coaxial with the plenum structure inlet 114. The collar 190 comprises a circumferential radially flange 191 which mates in an annular groove 193 formed in the beam 22. Thus, the collar 190 is mounted for rotational movement about its axis but is constrained against longitudinal axial movement. The threaded shank portion 188 of the rod 182 is threadably received in the threaded bore 192 of the collar 190. Additionally, a hollow tube 195 telescopically receiving the rod 182 is fixedly attached at one of its ends 197 to the top or upstream edge 97 of the beam 22, for example, by means of conventional screws 199 received through appropriate holes formed through a circumferential mounting ledge 201 projecting radially outwardly from the end 197 of the tube 195 further comprises a tongue 202 radially projecting inwardly from the interior wall surface of the hollow tube 195, which is tongue 202 is slidably received in the open channel 183 formed in the rod 182.

The positions of the square damper-diffuser plates 176 and 178 relative to the plenum structure inlet 114 is adjusted by turning the collar 190 about its axis. As the collar 190 is turned in one direction, for example, clockwise, the coaction between the threaded shank portion 188 of the rod 182 and threaded bore 192 formed in the collar 190 causes the rod 182 to move longitudinally toward the inlet 114 carrying with it the attached damper-diffuser plates 176 and 178. Concurrently, the tongue 202 received in the channel 183 formed in the rod 182 prevents the rod 182 from rotating about its axis, thus, preventing the square damper-diffuser plates 176 and 178 from moving out of registration with the square inlet 114. As the collar 190 is turned in the other direction, i.e., counter-clockwise, the coaction between the threaded shank portion 188 and threaded bore 192 causes the rod 182 to move longitudinally away from the inlet 114 conveying with it the attached damper-diffuser plates 176 and 178. Again, the tongue 202 interacting with the channel 183 prevents the rod 182 from rotating about its axis, thus, preventing the damper-diffuser plates from turning out of registration with the plenum structure inlet 114.

Figure 8:
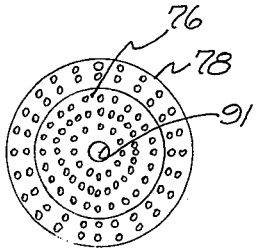
FIG. 8 is a top view of the damper-diffuser assembly.
Figure 9:
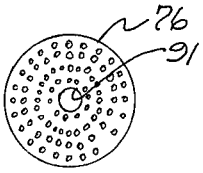
FIG. 9 is a top view of one damper-diffuser plate of the damper-diffuser assembly illustrated in FIG. 8.
Figure 10:
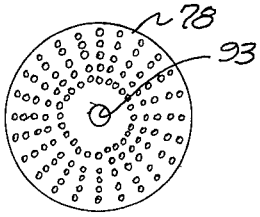
FIG. 10 is a top view of the other damper-diffuser plate of the damper-diffuser assembly illustrated in FIG. 8.

The damper-diffuser plates can take a number of shapes, in addition to the circular flat shape best illustrated in FIGS. 7, 8 and 9, and the square flat shape best illustrated in FIG. 15.

Figure 11:
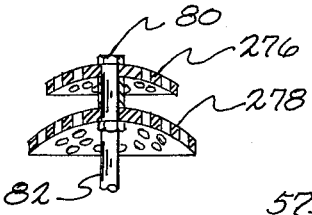
FIG. 11 is a sectional side view of another embodiment of a damper-diffuser assembly.

FIG. 11 shows two spaced apart coaxially disposed hemispherically shaped perforated damper-diffuser plates 276 and 278. The damper-diffuser plates 276 and 278 are coaxially aligned with and attached to one end 80 of the rod 82 so that they concavely face away from the plenum structure inlet 14.

Figure 12:
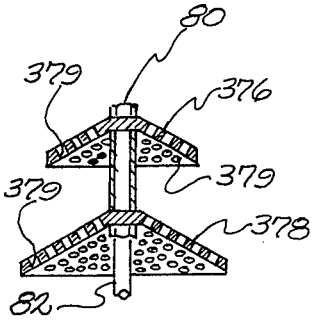
FIG. 12 is a sectional side view of another embodiment of a damper-diffuser assembly.

FIG. 12 shows two spaced apart coaxially disposed conically shaped perforated damper-diffuser plates 376 and 378. The damper-diffuser plates 376 and 378 are coaxially aligned with and attached to one end 80 of the rod 82 so that they concavely face away from the plenum structure inlet 14. The axis of the perforations 279 are normal to the slope of the conical damper-diffuser plates.

Figure 13:
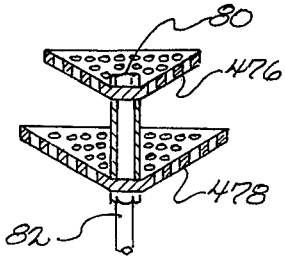
FIG. 13 is a sectional side view of another embodiment of a damper-diffuser assembly.

FIG. 13 shows two spaced apart coaxially disposed conically shaped perforated damper-diffuser plates 476 and 478 coaxially aligned with and attached at one end 80 of rod 82 so that they concavely face toward the plenum structure inlet 14.

Figure 14:
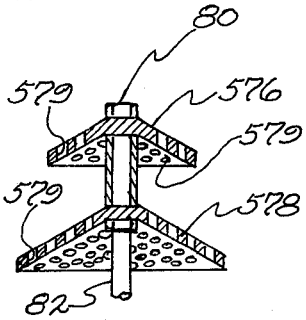
FIG. 14 is a sectional side view of another embodiment of a damper-diffuser assembly.

FIG. 14 illustrates another embodiment of a conical damper-diffuser plates 576 and 578 somewhat similar to the embodiment illustrated in FIG. 12 except that the axes of the perforations 579 are substantially parallel to the central axis of each of the cones through their apex.

Figure 3:
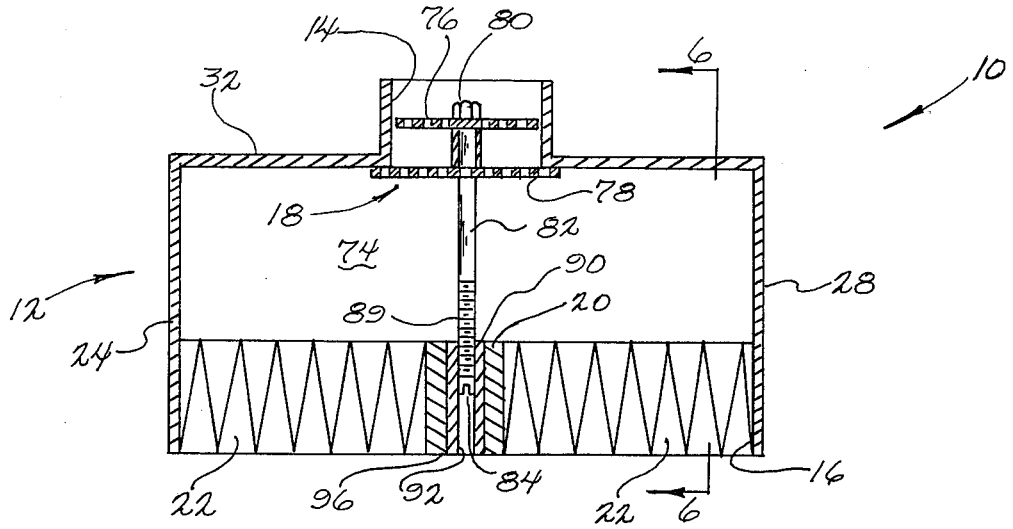
FIG. 3 is a cross-sectional side view of the ventilating air filtering and distributing device taken in the direction of arrows 3—3 in FIG. 2 and illustrating a damper-diffuser assembly in one position therein.
Figure 4:
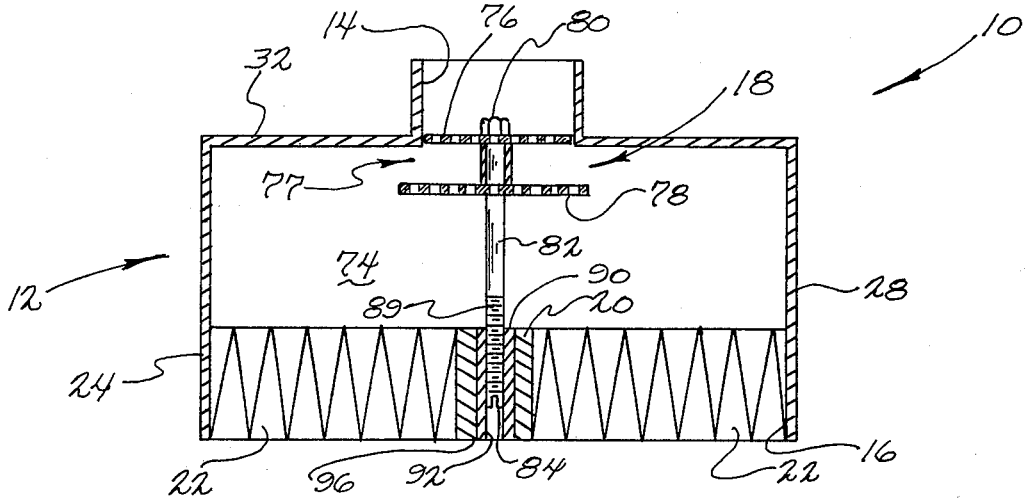
FIG. 4 is a cross-sectional side view of the ventilating air filtering and distributing device similar to FIG. 3 and illustrating the damper-diffuser assembly in another position.
Figure 5:
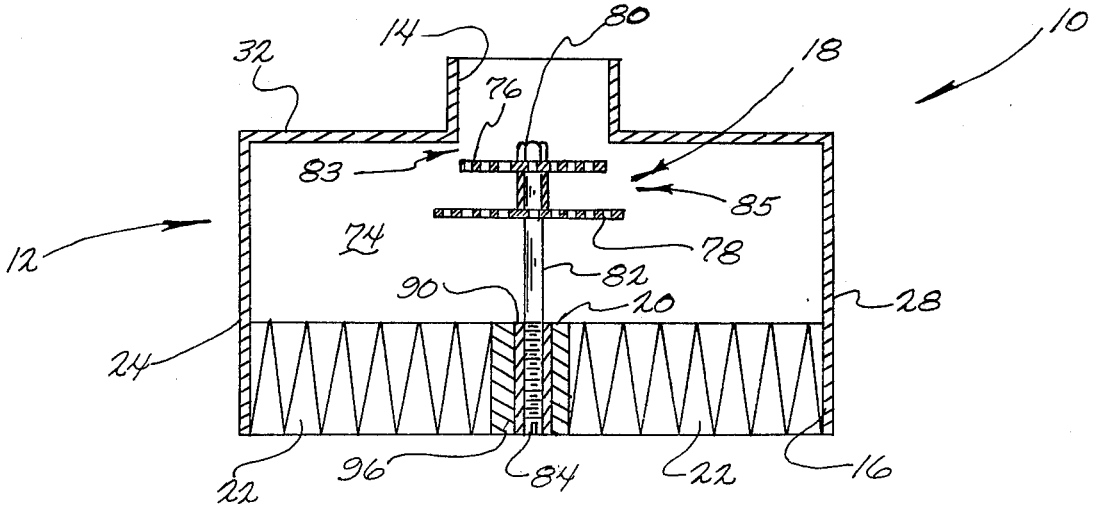
FIG. 5 is a cross-sectional side view of the ventilating air filtering and distributing device similar to FIG. 3 and illustrating the damper-diffuser assembly in yet another position.
Figure 6:
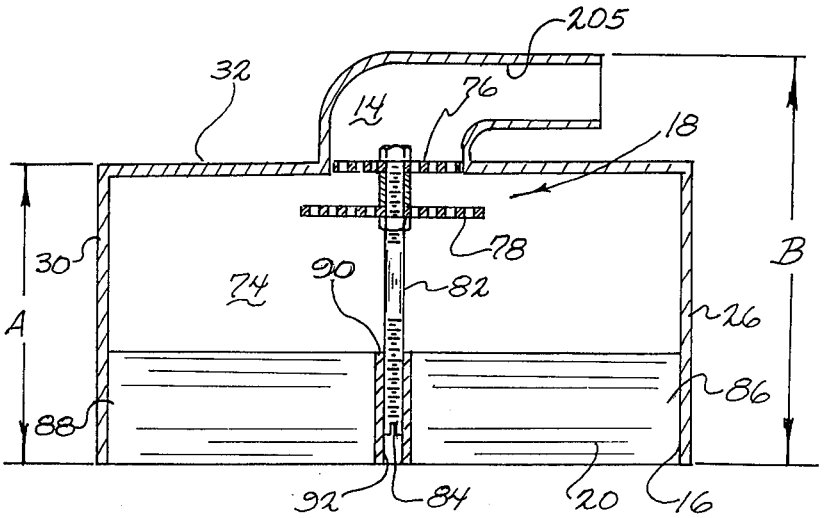
FIG. 6 is a cross-sectional end view of the ventilating air filtering and distributing device taken in the direction of arrows 6—6 in FIG. 3.

The operation of the device 10 will not be discussed and can best be followed by reference to FIGS. 3, 4 and 5.

FIG. 3 shows the damper-diffuser plates 76, 78 in the uppermost position wherein the top plate 76 is located inside the plenum structure inlet 14 and the bottom plate 78 abuts the plenum structure top wall 32 and, thus, covers the inlet 14. In this position, both the top plate 76 and bottom plate 78 act as dampers. That is, the plates 76 and 78 throttle or decrease the volume of dirty air flow passing through the inlet 14 into the plenum chamber 74 allowing incoming dirty air to pass only through the perforations therein.

FIG. 4 shows the damper-diffuser plates 76 and 78 in what will be referred to as an intermediate position for the sake of discussion. In this intermediate position, the top plate 76 is located inside the inlet and the lower plate 78 is spaced from the plenum structure top wall 32 away from the dirty air inlet 14. Thus, an annular open space, generally denoted by the numeral 77, is defined between the plenum structure top wall 32 and periphery of the bottom plate 78. In this intermediate position, the top plate 76 functions as a damper or throttling valve, allowing dirty air to pass through the perforations formed therein, and the bottom plate 78 functions as a diffuser to spread out or scatter the dirty air stream over the length and breadth of the upstream surface of the filter media 22.

FIG. 5 illustrates the damper-diffuser plates 76 and 78 in the lowermost position. In this position, the upper plate 76 is completely removed from the inlet 14 and is spaced from the top wall 32 thereby defining an annular space, generally denoted by the numeral 79, between the plenum structure top wall 32 and periphery of the top plate 76. In this lowermost position, the total area of the perforations in the top plate 76 plus the area of the annular space 79 is at least equal to the area of the inlet 14, thus, allowing the entire volume of air supplied to the inlet 14 to pass therethrough unhindered. Therefore, the top plate 76 functions as a diffuser to spread out or scatter the dirty air stream passing through the inlet 14 into the plenum chamber 74. Likewise, the bottom plate 78 is also spaced from the plenum structure top wall 32 by a greater distance than it was when in the intermediate position thereby defining a larger annular space, generally denoted by the numeral 81, between the plenum structure top wall 32 and periphery of the lower plate 78. Therefore, the lower plate 78 also functions as a diffuser further dispersing the dirty air over the length and breadth of the upstream surface of the filter media 22.

It should be understood that the above-discussed positions of the damper-diffuser plates 76, 78 represent only the three basic positions thereof and that the damper-diffuser plates can be adjusted to virtually an infinite number of positions between the uppermost and lowermost positions illustrated in FIGS. 3 and 5, respectively, the effect of any other position of the damper-diffuser plates 76, 78 on the incoming dirty air stream is one of degree, for example, a change in the amount of the throttling effect of the top damper-diffuser plate 76 on the incoming dirty air stream.

By efficiently damping and laterally diffusing or distributing the incoming dirty air stream, the present invention effectively converts much of the velocity pressure generated by the incoming dirty air stream to static pressure. The conversion of velocity pressure to static pressure coupled with the improved lateral air stream disbursion provided by the top and bottom perforated plates results in more uniform clean air flow velocities across the downstream surface of the filter 22 and, therefore, a more uniform clean air velocity profile than was possible using the prior art devices.

Additional practical advantages provided by the present invention are illustrated in FIG. 7. The present invention provides for both a low profile plenum structure, indicated by arrows "A", and for installation in a space having a minimum depth as indicated by arrows "B".

The low plenum structure profile "A" is the result of the improved lateral diffusion or dispersion effect of the damper-diffuser plates of the present invention on the incoming dirty air stream. This improved diffusion effect eliminates the need for larger plenum chamber depth between the plenum inlet and filter media required by the prior art to provide a sufficient distance over which the incoming air can travel as it flows from the plenum inlet to the filter media while it is being laterally dispersed.

The present invention can be installed in a space having a minimum depth "B" because of the fact that, unlike the prior art devices, there is no damper-diffuser mounting structure required in the inlet to the plenum chamber. Thus, a supply duct 205 can be attached to the plenum inlet 14 without having to supply or leave a space for such a damper-diffuser mounting structure.

Figure 19:
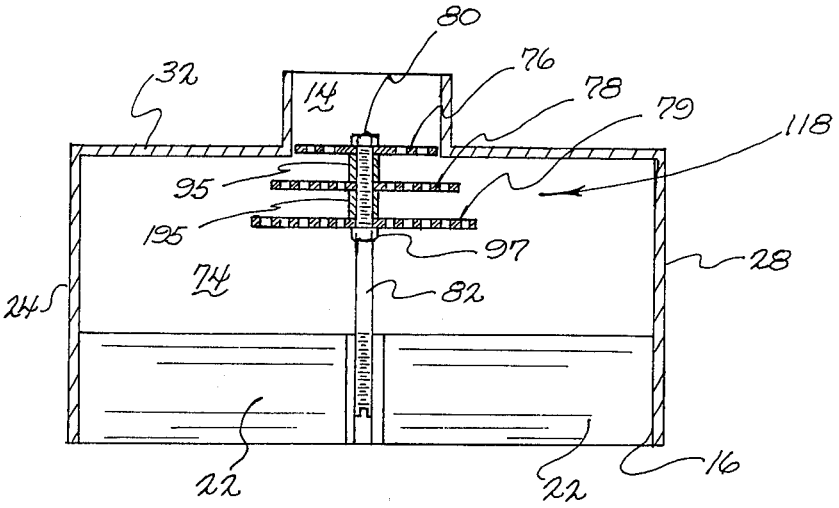

Referring now to FIG. 19, this embodiment of a damper-diffuser means 118 comprises three parallel spaced apart coaxially disposed perforated plates 76, 78 and 79 all of which are coaxially disposed relative to the plenum structure inlet 14. The plates 76, 78 and 79 are attached to one end 80 of movable adjustment rod 82 which is also coaxially disposed relative to the plenum structure inlet 14. Preferably, all three plates 76, 78 and 79 are of complementary shape to the inlet 14. That is, each plate 76, 78 and 79 presents a peripheral shape to the inlet 14 generally conforming to the shape of the inlet 14. Additionally, the top plate 76 is sized to be received in the inlet 14 while the plate 78 is larger than the inlet 14 and the plate 79 is larger than the plate 78. This embodiment is useful in applications where two perforated plates are not adequate to diffuse the incoming air to produce a uniform air flow velocity profile at the outlet 16 due to a high inlet air velocity.

The foregoing detailed description is given primarily for clearness of understanding and no unnecessary limitations should be understood therefrom, for modifications will become obvious to those skilled in the art upon reading this disclosure and may be made without departing from the spirit of the invention or the scope of the appended claims.

What is claimed is:

1. A ventilating air distributing device comprising:

a plenum structure defining a plenum chamber and having an inlet in one face and an outlet in the opposite face;

damper-diffuser support means attached to said plenum structures proximate said outlet therefrom;

an adjustment rod mounted to said support means and coaxially disposed relative to and extending axially toward said inlet for selective axial movement toward and away from said inlet;

at least two parallel spaced apart mutually coaxially disposed perforated plates coaxially disposed on and attached to the rod proximate the end of said rod closest to said inlet for movement toward and away from said inlet with said rod;

said perforated plate farthest from said plenum structure inlet is larger in area than said perforated plate closet to said plenum structure inlet, and said damper-diffuser support means comprises a beam attached at its opposite ends to the side walls of said plenum structure and extends across said outlet.

2. The ventilating air distributing device defined in claim 1, further comprising filter media disposed across said outlet from said plenum chamber.

3. The ventilating air distributing device defined in claim 1, wherein said plenum structure is generally in the shape of a parallelpiped.

4. The ventilating air distributing device defined in claim 1, wherein:

said support beam further comprises a threaded bore therethrough coaxially disposed relative to said plenum structure inlet; and, said adjustment rod comprises a threaded shank operatively engaged in said threaded bore formed in said support beam proximate the opposite end of said adjustment rod from said perforated plates, whereby as said rod is turned in one direction, it is caused to move, by the coaction of its threaded shank and threaded bore of said beam, longitudinally toward said plenum structure inlet, and as said rod is turned in the other direction, it is caused to more, likewise by the coaction of its threaded shank and threaded bore of said beam, longitudinally away from said plenum structure inlet.

5. The ventilating air distributing device defined in claim 4, wherein:

an internally threaded collar defines said threaded bore, said collar being mounted in said beam for rotational movement about its axis and constrained from longitudinal movement along its axis;

said adjustment rod comprises an elongated longitudinally disposed open channel extending for at least a portion of the length of said rod; and, a tube telescopically receiving said adjustment rod and comprising a tongue projection extending into said channel formed in said rod, said tube being fixedly attached proximate one of its ends to said support beam, whereby, as said rod is caused to move longitudinally toward and away from said hood structure inlet by the coaction of its threaded shank and said threaded bore, and said projection of said tube prevents rotational movement of said rod, and, therefore, rotational movement of said perforated plates connected to one end of said rod.

6. The ventilating air distributing device defined in claim 1, wherein said damper-diffuser means comprises three parallel spaced apart mutually coaxially disposed perforated plates coaxially disposed relative to said plenum structure inlet.

7. The ventilating air distributing device defined in claim 1, wherein the perforated plate disposed furthest from said inlet presents a peripheral shape to said inlet generally conforming to the shape of said inlet.

8. The ventilating air distributing device defined in claim 7, wherein each of said perforated plates are substantially flat.

9. The ventilating air distributing device defined in claim 7, wherein each of said perforated plates are generally concavely formed.

10. The ventilating air distributing device defined in claim 9, wherein each of said concave perforated plates concavely face toward said inlet.

11. The ventilating air distributing device defined in claim 9, wherein each of said concave perforated plates convexly face toward said inlet.

12. The ventilating air distributing device defined in claim 11, wherein each of said concave perforated plates is generally a hemisphere.

13. The ventilating air distributing device defined in claim 9, wherein each of said concave perforated plates is generally a cone.

14. The ventilating air distributing device defined in claim 7, wherein:

the shape of said inlet is generally circular; and, said peripheral shape of said perforated plates presented to said inlet is generally circular.

15. The ventilating air distributing device defined in claim 7, wherein:

the shape of said inlet is generally rectangular; and, said peripheral shape of said perforated plates presented to said inlet is generally rectangular.

* * * * *